United States Patent [19]

Sasaki et al.

[11] 4,426,411

[45] Jan. 17, 1984

[54] METHOD OF FABRICATING A STEEL PRESSURE ROLL FOR USE IN A PRESSURE-FIXATION APPARATUS

[76] Inventors: Yoshitaka Sasaki, 100-1, Ohaza-higashibeppu, Kumagaya-shi, Saitama-ken; Keitaro Yamashita, 579, Ohaza-Jimboharacho, Kamisato-machi, Kodama-gun, Saitama-ken, both of Japan

[21] Appl. No.: 215,413

[22] Filed: Dec. 11, 1980

Related U.S. Application Data

[62] Division of Ser. No. 23,001, Mar. 22, 1979, abandoned.

[30] Foreign Application Priority Data

Mar. 23, 1978 [JP] Japan ..... 53-37370

[51] Int. Cl.[3] ..... B05D 3/04; B05D 3/12; C25D 5/44; C25D 7/04

[52] U.S. Cl. ..... 427/349; 204/25; 204/35 R; 204/36; 204/51

[58] Field of Search ..... 204/25, 51, 35 R, 36; 427/349; 308/241; 100/176; 118/637; 226/190, 193; 271/273; 432/59, 60, 227, 228

[56] References Cited

U.S. PATENT DOCUMENTS

| | | | |
|---|---|---|---|
| 1,228,178 | 5/1917 | Brooker . | |
| 3,063,763 | 11/1962 | Zubrisky | 308/241 |
| 3,141,593 | 7/1964 | Selsted et al. | 226/193 |
| 3,317,411 | 5/1967 | Letendre | 204/25 X |
| 3,343,484 | 9/1967 | Dahlgren | 101/148 |
| 3,647,525 | 3/1972 | Dahlgren | 101/148 X |
| 3,874,843 | 4/1975 | Fujimoto | 432/60 |
| 3,874,894 | 4/1975 | Pedersen | 118/116 X |
| 3,990,391 | 11/1976 | Singh | 118/116 |
| 4,065,365 | 12/1977 | Ibarguengoitia | 204/36 X |

FOREIGN PATENT DOCUMENTS 2607271 4/1977 Fed. Rep. of Germany .

OTHER PUBLICATIONS

*Modern Electroplating,* Lowenheim, Frederick A., John Wiley & Sons, Inc., pp. 131–134, 1974.

*Primary Examiner*—Michael R. Lusignan
*Attorney, Agent, or Firm*—Finnegan, Henderson, Farabow, Garrett & Dunner

[57] ABSTRACT

A hardened and chrome plated steel roller is shot-blasted with sharp-edged particles (e.g. of 300–400 mesh) to provide sharp-edged recesses on the roll surface, and then shot-blasted a second time with steel balls (e.g. of 30–40 microns) to round the sharp edges of the recesses, to provide a smooth, but low luster, surface.

2 Claims, 2 Drawing Figures

METHOD OF FABRICATING A STEEL PRESSURE ROLL FOR USE IN A PRESSURE-FIXATION APPARATUS

This is a division of application Ser. No. 023,001 filed Mar. 22, 1979, now abandoned.

FIELD OF THE INVENTION

This invention relates to pressure-fixation apparatus for use in an electrophotographic duplicator, and, more particularly, to the surface of the pressure rolls in such apparatus.

BACKGROUND OF THE INVENTION

In electrophotographic duplicating apparatus, it is customary to adhere magnetic toner to an image-bearing surface to develop the image, to transfer the adhered toner to a copy paper, and then to fix the transfered toner to the paper. The fixation may be accomplished by pressure or heat.

In a system for fixing the toner to the copy paper by pressure, the copying paper with the toner image formed thereon is passed between two pressure-fixation rolls. In general, a conventional pressure-fixation roll for pressure-fixation apparatus is treated with a surface-hardening process and hard chrome plating process, and then ground and polished to obtain a surface roughness from 0.3 to 0.8 microns. In this connection roughness means the average height of surface irregularities. Accordingly, the surface of an image fixed under pressure by a pressure-fixation roll with a polished surface of said fine roughness is so smooth and bright as to reflect light and is difficult to see clearly in a strong light.

SUMMARY OF THE INVENTION

It is, therefore, a principal object of this invention to provide pressure-fixing rolls with a surface for obtaining an image free from glare.

To achieve the object and in accordance with the purpose of the invention, the pressure-fixation roll of the invention has an aventurine-like surface with a surface roughness of 0.2 to 3.0 microns.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Figure 1:
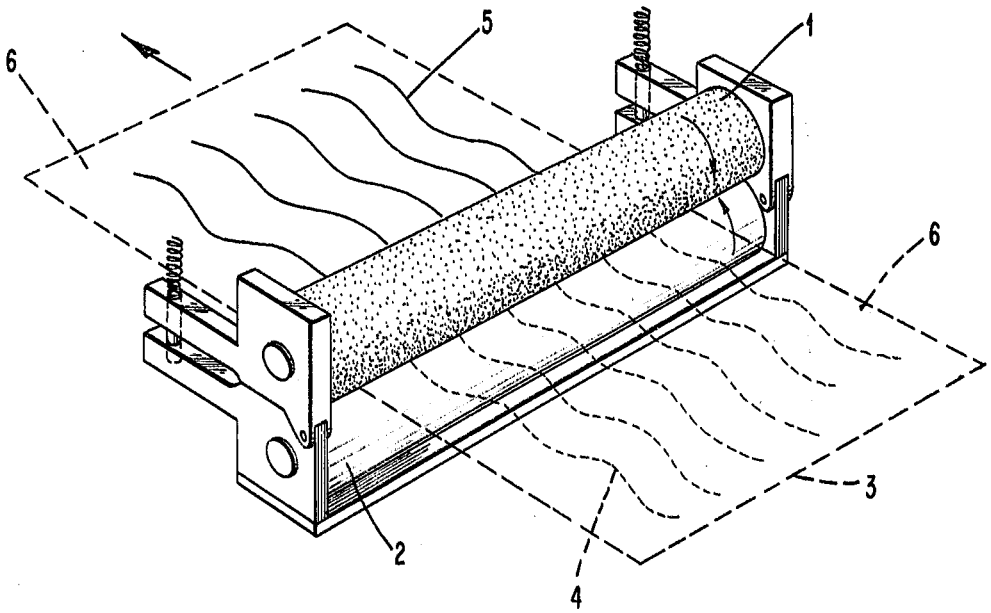
FIG. 1 is a perspective view of pressure-fixation apparatus incorporating one embodiment of the present invention.
Figure 2:
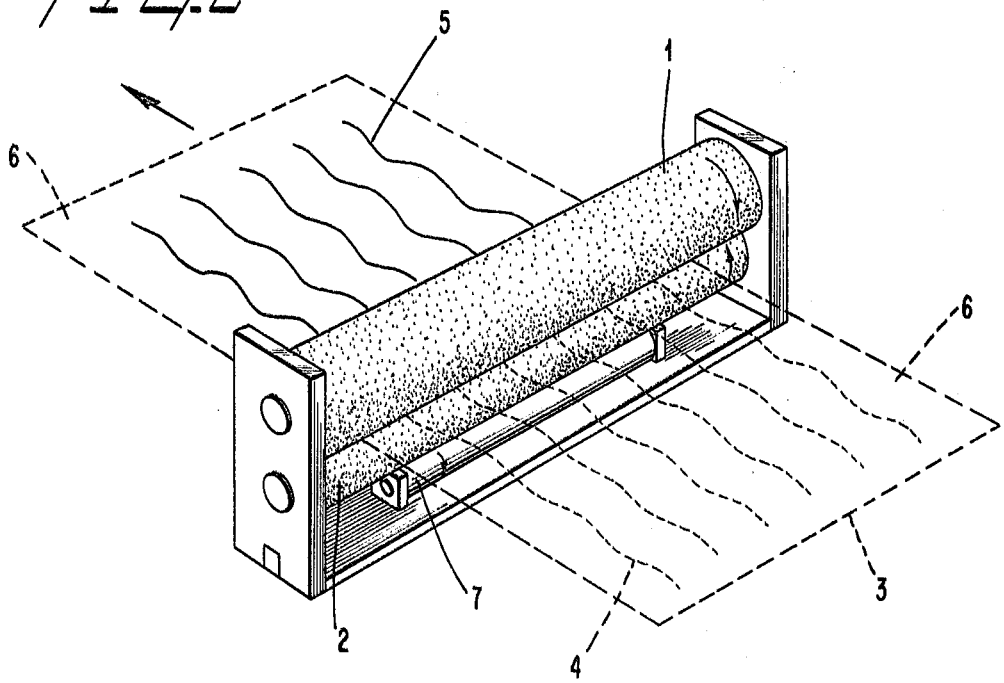
FIG. 2 is a perspective view of pressure-fixation apparatus incorporating another embodiment of the present invention.

Pressure-fixation apparatus may include, as shown in FIGS. 1 and 2, a top pressure roll 1, a bottom pressure roll 2, copying paper 3, toner 4 adhered to the paper 3 to develop an image 5 in an image plane 6, and a backup roll 7.

In the apparatus of FIG. 1, the top roll 1 and bottom roll 2 are biased into rolling engagement and are rotated in senses to advance the copy paper between the rolls 1, 2. When copying paper 3 having toner 4 developed on, or transferred to, its surface is advanced between the pressure rolls 1, 2, the toner is pushed into the surface of the paper to fix the image 5.

With a pressure-fixation apparatus of the present invention, an aventurine-like surface is formed on the surface of top roll 1 in contact with the surface of copying paper 3 with toner image 5 thereon or in contact with the image plane 6. Therefore, the surface toughness of image 5 formed by toner 4 and fixed under pressure to copying paper 3 corresponds to the roughness of the aventurine-like surface of top roll 1.

Accordingly, as a light beam projected on the aventurine-like surface of top roll 1 reflects irregularly, the reflection of image 5 becomes dull and mat. This image 5 is very easy to read, even when the light is projected from a single direction.

In addition to this advantage, it was found after various experiments that a range 0.2–3.0 microns of roughness of the aventurine-like surface is fine enough to obtain a desirable image, and yet prevent the offset, or phenomenon, that toner 4 at the time of fixation under pressure partially attaches to the surface of top roll 1 and the thus attached toner is transferred back to the plane 6 of image 5.

An aventurine-like surface can be formed on a pressure roll of pressure-fixation apparatus by treating the surface of the steel pressure roll. The steel roll may be treated with hardening process and then with hard chrome plating process, and subsequently may be worked with grinder and shot-blast machine. In addition to mechanical means for forming an aventurine-like surface, physio-chemical means may be used for treating the surface.

More specifically, the pressure roll of the pressure-fixation apparatus of the present invention may be prepared by the following process. The surface of the roll which has hard chrome plating is treated by shot-blasting with hard particles with sharp edges, the particle size of which is preferably 300 to 400 mesh. By the shot-blasting, the surface receives thousands of recesses with sharp edges. Then, the surface is treated by a second shot-blasting with steel balls, the sharp edges of the recesses on the roll surface thereby being rounded. The steel balls have preferably the particle sizes of 30 to 40 microns.

Although the roughness of the pressure roll by the present invention is 0.2 to 3.0 microns and the conventional polished roll has its surface roughness of 0.3 to 0.8 microns, the luster of the toner image by the present pressure roll is completely different from that by the conventional roll. The luster of toner image fixed by the present pressure-fixation apparatus is observed to be 15 to 25 by a lustermeter which is available by Gardner Laboratory, Inc., while that of toner image fixed by a conventional polished roll is 50 to 60. The luster by the present invention is much nearer to the value of 3 to 5 obtained by a heat-fixing method.

The low luster by the present apparatus is thought to be caused by the larger pitch of the recesses on the roll surface.

Through an example for forming an aventurine-like surface on the top roll 1 in contact with the image surface 6 of copying paper 3 was described with reference to FIG. 1, both top roll 1 and bottom roll 2 may have aventurine-like surfaces. In FIG. 2, which represents an example for pressure-fixation apparatus of three-roll system equipped with backup roll 7, aventurine-like surface may be formed on both top roll 1 and bottom roll 2.

As described hereinbefore, with the pressure-fixation apparatus for electrophotographic duplicator of dry type of the present device, and aventurine-like surface is formed on pressure-fixation rolls so that the plane of an image fixed under pressure may have a roughness corresponding to that of the aventurine-like surface and a projected light beam reflects irregularly whereby a high quality image free from glare and free from offset is obtained.

What is claimed is:

1. A method of treating the surface of a steel pressure roll for use in pressure-fixation apparatus of electrophotographic duplicating apparatus for reducing glare of the pressure-fixed image comprising the steps of:

a. hardening the surface of the steel pressure roll;

b. hard chrome-plating the hardened surface;

c. first shot-blasting the chrome-plated surface with sharp-edged hard particles, said first-shot blasting step for providing a surface substantially covered with sharp-edged recesses; and d. second shot-blasting the first shot-blasted surface with steel balls, said second shot-blasting step for rounding the sharp edges of the recesses.

2. The method of claim 1 wherein the range of size of said sharp-edged hard particles is 300 to 400 mesh and wherein the range of size of said steel balls is 30 to 40 microns.

* * * * *